US006494339B1

(12) United States Patent
Engelhard et al.

(10) Patent No.: US 6,494,339 B1
(45) Date of Patent: Dec. 17, 2002

(54) CUP HOLDER

(76) Inventors: John S. Engelhard, 3776 Keokuk, Saint Louis, MO (US) 63116; Cindy M. Engelhard, 3776 Keokuk, Saint Louis, MO (US) 63116

( * ) Notice: Subject to any disclaimer, the term of this patent is extended or adjusted under 35 U.S.C. 154(b) by 0 days.

(21) Appl. No.: 10/000,162

(22) Filed: Dec. 4, 2001

(51) Int. Cl.[7] ..... B65D 25/22

(52) U.S. Cl. ..... 220/475; 220/739; 220/738; 220/902; 220/DIG. 25

(58) Field of Search ..... 220/475, 739, 220/738, 751, 902, DIG. 25; 248/311.2; 229/403

(56) References Cited

U.S. PATENT DOCUMENTS 2,963,256 A 12/1960 Borah
3,061,089 A * 10/1962 Higgins ..... 206/217
4,973,018 A 11/1990 Agor
5,169,315 A 12/1992 Bull
5,485,931 A 1/1996 Barr, Jr.
5,732,862 A 3/1998 Bull
6,029,938 A 2/2000 Fava
D422,182 S * 4/2000 Miljanich
6,179,166 B1 * 1/2001 Dallas, Jr. ..... 220/475
6,267,461 B1 * 7/2001 Dunagan et al. ..... 220/345.1
6,338,419 B1 * 1/2002 Penney ..... 220/475

* cited by examiner

*Primary Examiner*—Joseph M. Moy
(74) *Attorney, Agent, or Firm*—Stephen R. Greiner

(57) ABSTRACT

A cup holder including a resilient tube having opposed ends with a keyhole slot open at its bottom extending between the opposed ends for engaging a support and the tube also having a bore in its top for receiving a beverage container.

3 Claims, 1 Drawing Sheet

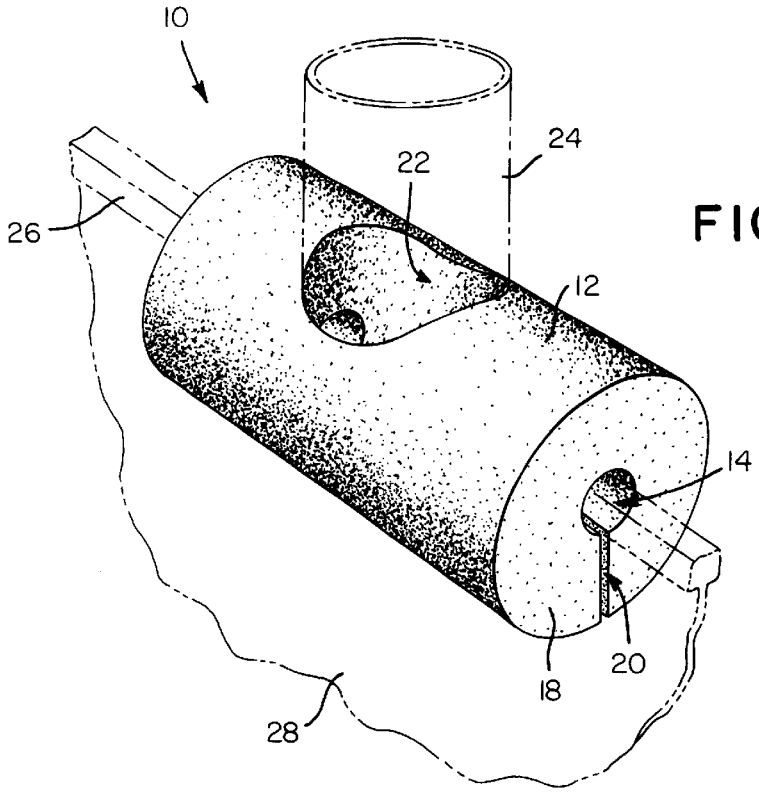
FIG. 1
FIG. 2
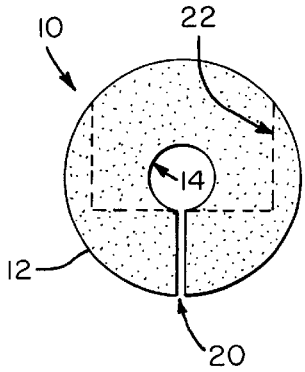
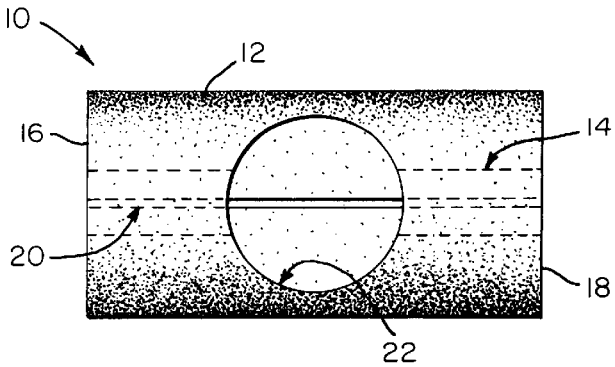
FIG. 3
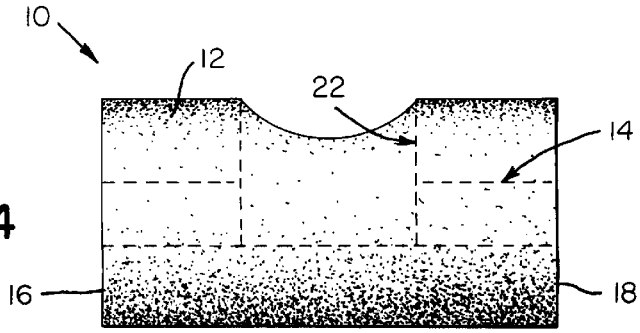
FIG. 4

CUP HOLDER

FIELD OF THE INVENTION

The present invention relates generally to receptacles and, more particularly, to container attachments or adjuncts.

BACKGROUND OF THE INVENTION

After paddling for a long period of time, most canoeists enjoy a sip of water or other beverage to avoid dehydration. Unfortunately, most open-topped canoes lack cup holders that permit ready access to a drink. Balancing a cup on the narrow gunwale or thwart of a canoe is virtually impossible. Of course, resting a cup upon the bottom of a canoe subjects it to inadvertent kicks by canoeists as well as tips by an unexpected waves. A need, therefore, exists for a safe, handy, and inexpensive cup holder for use by canoeists and others.

SUMMARY OF THE INVENTION

In light of the problems associated with retaining a beverage containers upright in a canoe, it is a principal object of the invention to provide a device that will snugly, yet releasably, hold a cup or like container in an upright condition upon a canoe gunwale or other support. The preferred device is formed from a resilient foam material that serves as an insulator to keep the beverage within the cup or container at a desired temperature. When suitably positioned upon a canoe gunwale, the device can serve as a bumper or rest for the knees and thighs of a paddler. Since the resilient foam material is buoyant, the device cannot sink if it falls from a canoe into a body of water.

It is another object of the invention to provide a cup holder of the type described that can be set up and used with minimal instruction and without tools. The cup holder can accommodate supports and containers of various sizes.

It is an object of the invention to provide improved elements and arrangements thereof in a cup holder for the purposes described which is lightweight in construction, inexpensive to manufacture, and dependable in use. It is foreseeable that the cup holder will be used away from canoes, perhaps, by way of example only, in securing beverage containers to the armrests and backs of sporting arena seats or in securing beverage containers to the tops of dugout fences in ballparks.

Briefly, the cup holder in accordance with this invention achieves the intended objects by featuring a tube formed of a resilient foam material. The tube has a central passageway extending between its opposed ends. A bottom passageway extends downwardly from the central passageway to the bottom of the tube. The bottom passageway and the central passageway, when taken together, define a keyhole slot open at its bottom that extends the length of tube for receiving a support. A cylindrical bore penetrates the top of the tube and the central passageway for receiving a cup or other form of container.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a perspective view of a cup holder in accordance with the present invention.

FIG. 2 is an end view of the cup holder of FIG. 1.

FIG. 3 is a top view of the cup holder.

FIG. 4 is a side view of the cup holder.

Similar reference characters denote corresponding features consistently throughout the accompanying drawings.

DETAILED DESCRIPTION OF THE PREFERRED EMBODIMENT

Referring now to the FIGS., a cup holder in accordance with the present invention is shown at 10. Cup holder 10 includes a hollow cylinder or tube 12 formed of resilient polyethylene foam. Tube 12 has a central passageway 14 extending between its opposed ends 16 and 18. A lower passageway 20 extends downwardly from the bottom of central passageway 14 to the bottom of tube 12. Central passageway 14 has a relatively greater width than lower passageway 20; thus, when taken together, central passageway 14 and bottom passageway 20 define a keyhole slot open at its bottom and extending the length of tube 12. A cylindrical bore 22 is provided in the top of tube 12 within which may be snugly positioned a cup 24 or like container.

Use of cup holder 10 is straightforward. First, bottom passageway 20 in tube 12 is pulled open somewhat to accommodate the gunwale 26 forming the top of the sidewall 28 of a canoe or a similar support. Next, tube 12 is pushed downwardly onto sidewall 28 until gunwale 26 nests fully within central passageway 14. Now, with tube 12 firmly clamped upon sidewall 28, the bottom of cup 24 is slid into cylindrical bore 22. Gunwale 26 serves as a stop or rest for cup 24 thereby permitting cup 24 to be removed repeatedly and easily from bore 22 whenever a user desires to refresh his thirst.

After use of cup holder 10, it may be left in place or removed from its support and washed with soap and water, if necessary. It may, then, be stored in a convenient location such as a tackle box, cabinet drawer or vehicle trunk for later use. Its compact size and light weight permit cup holder 10 to be taken practically anywhere.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

We claim:

1. A cup holder comprising a resilient tube having opposed ends with a keyhole slot open at its bottom extending between said opposed ends for engaging a support and said tube also having a bore in the top thereof for receiving a beverage container.

2. A cup holder, comprising:

a tube formed of a resilient foam material, said tube having:

opposed ends;

a central passageway extending between said opposed ends;

a bottom passageway extending between said opposed ends and extending downwardly from the bottom of said central passageway to the bottom of said tube, and said bottom passageway being relatively narrower than said central passageway; and, a bore penetrating the top of said tube.

3. A cup holder, comprising:

a tube formed of a resilient foam material, said tube having:

opposed ends;

a central passageway extending between said opposed ends;

a bottom passageway extending between said opposed ends and extending downwardly from the bottom of said central passageway to the bottom of said tube, said bottom passageway and said central passageway together defining a keyhole slot open at its bottom and extending the length of tube for receiving a support; and, a cylindrical bore penetrating the top of said tube and said central passageway for receiving a beverage container.

* * * * *